United States Patent [19]

Lewis et al.

[11] 4,226,083

[45] Oct. 7, 1980

[54] METHOD AND APPARATUS FOR REDUCING NITROUS OXIDE EMISSIONS FROM COMBUSTORS

[75] Inventors: George D. Lewis, North Palm Beach; Paul L. Russell, Lake Park; Jeffrey Stettler, Palm Beach Gardens, all of Fla.

[73] Assignee: United Technologies Corporation, Hartford, Conn.

[21] Appl. No.: 870,789

[22] Filed: Jan. 19, 1978

[51] Int. Cl.[2] ..... F02C 7/22

[52] U.S. Cl. ..... 60/39.06; 60/748

[58] Field of Search ..... 60/39.71, 39.74 R, 39.74 B, 60/39.06; 431/10; 261/79.4, 180 S, 180 M

[56] References Cited

U.S. PATENT DOCUMENTS

| | | | |
|---|---|---|---|
| 2,931,174 | 4/1960 | Allen | 60/39.71 |
| 3,722,216 | 3/1973 | Bahr et al. | 60/39.74 R |
| 3,973,390 | 8/1976 | Jeroszko | 60/39.71 |
| 3,976,420 | 8/1976 | Takahashi et al. | 431/10 |
| 4,052,844 | 10/1977 | Carvel et al. | 60/39.71 |
| 4,058,977 | 11/1977 | Markowski et al. | 60/39.71 |

*Primary Examiner*—Robert E. Garrett
*Attorney, Agent, or Firm*—Robert C. Walker

[57] ABSTRACT

An improved combustor for a gas turbine engine is disclosed. Techniques for reducing the level of noxious pollutants emitted by the combustor are developed. In one embodiment, a combination of serpentine geometried, fuel-mixing tubes discharging to the radially outward area of the combustor and an axially oriented, fuel-mixing tube near the center of the combustor are adapted to generate a strong centrifugal force field within the combustor. The force field promotes rapid mixing and combustion within the chamber to reduce both the magnitude of the combustor temperature and the period of exposure of the medium gases to that temperature. In accordance with the method taught, the fuel air ratio in the serpentine mixing tubes is maintained within the range of 0.035 to 0.05 and the fuel air ratio in the axial mixing tube is maintained at a value less than 0.05.

6 Claims, 6 Drawing Figures

METHOD AND APPARATUS FOR REDUCING NITROUS OXIDE EMISSIONS FROM COMBUSTORS

BACKGROUND OF THE INVENTION

This application relates to applications Ser. No. TPM-132 and Ser. No. TPM-149, filed on even date and of common assignee herewith.

1. Field of the Invention

This invention relates to fuel combustors and more specifically, to combustors for gas turbine engines in which fuel and air are mixed before injection into the combustion zone of the combustor.

2. Description of the Prior Art

Within the gas turbine engine field, combustion principles are among the most difficult phenomenon to describe and predict. Accordingly, over the last four decades, combustion apparatus has gone through dramatic alteration after alteration as new scientific theories and techniques are advanced.

Among the most recent and most promising techniques are those known generically within the industry as "swirl burning". Basic swirl burning concepts are discussed in U.S. Pat. No. 3,675,419 to Lewis entitled "Combustion Chamber Having Swirling Flow" and in U.S. Pat. No. 3,788,065 to Markowski entitled "Annular Combustion Chamber for Dissimilar Fluids in Swirling Flow Relationship". The concepts described in these patents are now employed to effect rapid and efficient combustion, yet stringent anti-pollution objectives are imposing further demand for advances in technology.

Perhaps the most imposing anti-pollution objective facing scientists and engineers is the requirement for reduced levels of nitrous oxide emission. Nitrous oxides are produced, for example, in accordance with the simplified reactions shown below.

$$N_2+O_2+\text{Heat}\rightarrow 2NO$$

$$2NO+O_2\rightarrow 2NO_2$$

The reactions require both the presence of oxygen and very high temperatures. Limiting either the oxygen present or the fuel combustion temperature substantially reduces the levels of nitrous oxide produced. Under normal conditions, the amount of oxygen in the combustor cannot be reduced without the deleterious side effect of increasing the level of hydrocarbon emission. Excess oxygen is required to assure that the fuel is completely burned. It is, therefore, that reductions in combustor temperature and reductions in the time exposure of the free nitrogen and excess oxygen to the combustor temperature offer more positive approaches to nitrous oxide reduction.

One very recent advance for reducing the level of nitric oxide pollutants in combustor effluent is disclosed in U.S. Pat. No. 3,973,375 to Markowski entitled "Low Emission Combustion Chamber". In U.S. Pat. No. 3,973,375, combustor fuel is vaporized in the vitiated effluent of a pilot burner and is subsequently diluted to a lean fuel air ratio downstream thereof. Vaporizing the fuel in the vitiated effluent effects an ignition lag such that autoignition does not occur before lean ratios are achieved.

Yet, further advances are desired and new techniques and concepts need be developed. To this end manufacturers and designers of gas turbine engines are continuing to direct substantial economic and personnel resources toward the advancement and attainment of anti-pollution objectives.

SUMMARY OF THE INVENTION

A primary aim of the present invention is to improve the operating capabilities of a gas turbine engine. Efficient operation at reduced levels of pollutant emission is sought with a specific object being to reduce the level of nitrous oxide emission from the combustors of engines.

According to the present invention, a plurality of primary, or pilot mixing tubes are adapted to circumferentially swirl a fuel/air mixture dischargeable therefrom into the radially outward region of a cylindrical combustor, and a secondary mixing tube is adapted to swirl a fuel/air mixture dischargeable therefrom into the central portion of the combustor such that the two swirling mixtures establish a strong centrifugal force field in the combustor thereby impelling the secondary fuel/air mixture radially outward into the primary fuel/air mixture upon ignition of the primary fuel/air mixture.

In further accordance with the present invention a method for limiting nitrous oxide emissions from a combustor includes flowing fuel and air into primary mixing tubes at a ratio between approximately fifty to seventy-five percent (50–75%) of the stoichiometric ratio for the fuel employed; mixing the fuel and air in the primary mixing tubes; discharging the mixture from the primary mixing tubes circumferentially into the outer portion of a combustor; igniting said mixture from the primary mixing tubes; flowing fuel and air into secondary mixing tubes at a ratio not exceeding approximately seventy-five percent (75%) of the stoichiometric ratio for the fuel employed; mixing the fuel and air in the secondary mixing tube; imparting a circumferential swirl to the fuel and air mixture; discharging the swirling fuel and air mixture from the secondary tube to the central portion of the combustor, whereby the secondary fuel and air mixture is centrifuged radially outward into the ignited primary mixture.

One feature of the present invention is the primary, or pilot fuel tubes at the upstream end of the combustor. As illustrated, the pilot tubes have a serpentine geometry and are adapted to flow the fuel/air mixture circumferentially into the outer portion of the combustor. Another feature is the secondary fuel premixing tube which is located near the axis of the combustor. As illustrated, the secondary tube has a swirler at the downstream thereof which is adapted to impart a circumferential swirl to the fuel/air mixture emanating therefrom. Separate means for flowing fuel to the primary and secondary mixing tubes enable staging of the fuel flow to the combustion chamber.

A principal advantage of the present invention is improved fuel vaporization and mixing as effected by the strong, centrifugal force field. Forced mixing of the primary and secondary fuel streams in the centrifugal force field promotes rapid combustion in a reduced axial length. Reducing the axial length of the combustor lowers the amount of nitric oxide emissions ($NO_x$) by limiting the exposure time of the combusting gases to extreme temperatures within the combustor. Collaterally, nitric oxide emissions are reduced by limiting the fuel/air ratio within the combustor to lean values below stoichiometric conditions. Premixing the primary fuel and secondary fuel in the respective mixing tubes assures the desired lean fuel/air ratios upon injection into the combustion zone.

The foregoing, and other objects, features and advantages of the present invention will become more apparent in light of the following detailed description of the preferred embodiment thereof as shown in the accompanying drawing.

DETAILED DESCRIPTION OF THE DRAWING

DETAILED DESCRIPTION

Figure 1:
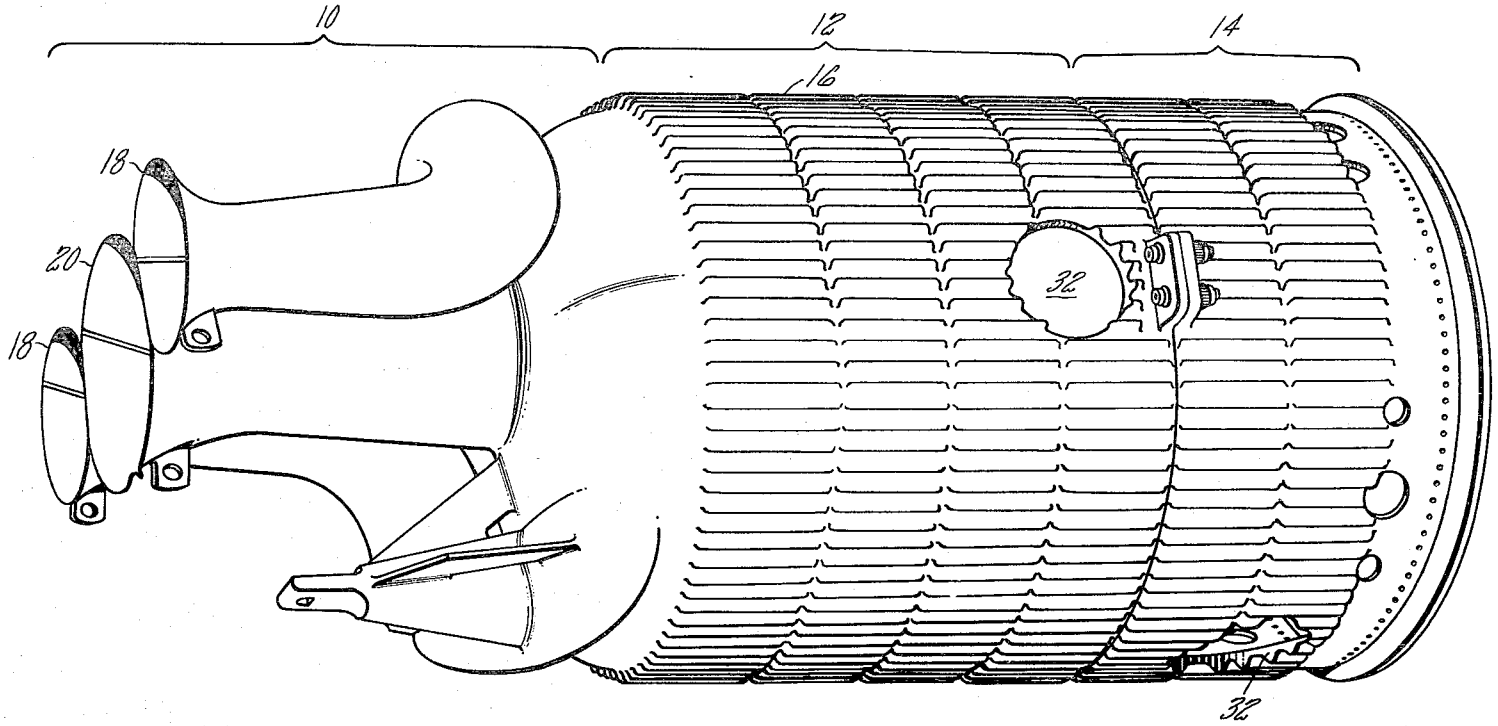
FIG. 1 is a simplified external perspective view of the combustor.

A can type combustion chamber, or combustor is illustrated by the FIG. 1 perspective view. the combustor has a fuel/air mixing zone 10, a combustion zone 12, and a dilution zone 14. The combustion zone is formed by a cylindrical body 16. The fuel/air mixing zone includes a plurality of primary, or pilot mixing tubes 18 and a single secondary, or main mixing tube 20. Each of the tubes 18 has a serpentine geometry and is adapted to discharge the gases flowing therethrough circumferentially into the radially outward portion combustion zone of the combustor. The main mixing tube 20 is axially oriented with respect to the chamber and is positioned near, but not necessarily coincident with, the axis of the chamber. The tube 20 is adapted to discharge the gases flowing therethrough into the central portion of the combustion zone.

Figure 2:
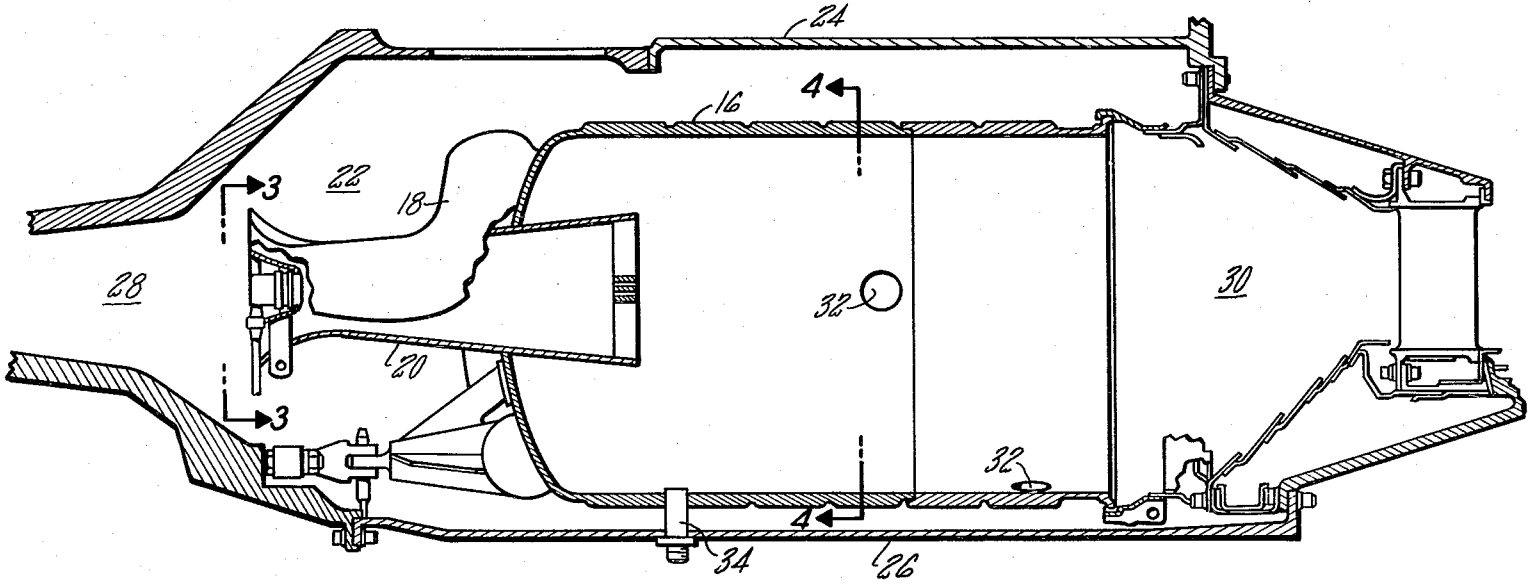
FIG. 2 is a simplified cross section view of the combustor illustrated in FIG. 1 as installed in an engine.

The combustor is shown in greater detail in the FIG. 2 cross section view. Although a single combustor is shown, it is anticipated that a plurality of combustors will be employed in each engine. The combustors, numbering perhaps on the order of eight (8) or ten (10), are circumferentially spaced about the engine in an annulus 22 between an inner engine case 24 and an outer engine case 26. A diffuser 28 leads axially into the annulus 22 from a compression section (not shown). Each combustor discharges through a transition duct 30 to a turbine section (not shown). Dilution air is flowable into the dilution zone of the combustor through the dilution holes 32. An ignitor 34 penetrates the combustor in the region of discharge of the fuel/air mixture from the primary tubes 18.

Figure 3:
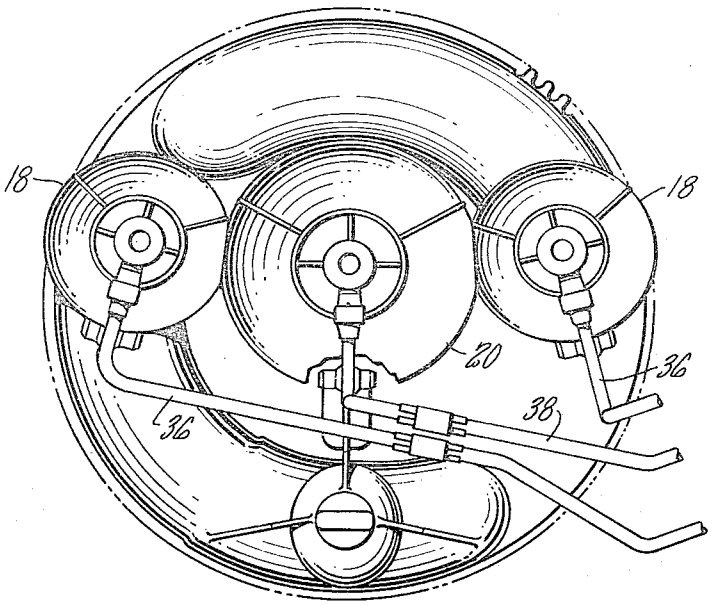
FIG. 3 is a front view of the combustor illustrated in FIG. 1.

FIG. 3 is a front view of the combustor. Each of the primary tubes 18 has a fuel supply means 36 disposed at the upstream end thereof. The secondary tube 20 has a fuel supply means 38 disposed at the upstream end thereof. The primary fuel supply means and the secondary fuel supply means are independently operable so as to enable staging of the fuel flow to the combustor.

Figure 4:
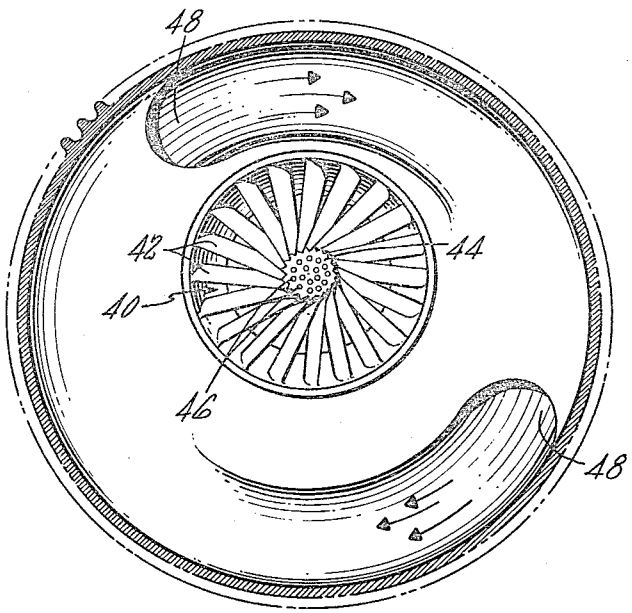
FIG. 4 is a cross section view taken through the combustor in the direction 4—4 as shown in FIG. 2.

FIG. 4 is a cross section view through the combustor looking in the upstream direction through the combustion zone. The downstream end of the secondary tube 20 has a swirler 40 disposed thereacross. The swirler is comprised of a plurality of vanes 42 for imparting a circumferential swirl to the medium gases flowing through the secondary mixing tube. A central plug 44 having a plurality of holes 46 disposed therein is positioned at the center of the mixing tube. Each of the primary or pilot mixing tubes 18 (not shown) discharges into the combustion chamber through a corresponding aperture 48. Flow discharged through the apertures 48 is caused to swirl circumferentially about the chamber in a direction opposite to that at which the gases are discharged from the secondary mixing tube.

During operation of the combustor, fuel is flowable through the supply means 36 to the primary mixing tubes 18. The fuel mixes with air in the primary tubes in a ratio which is within the range of approximately fifty to seventy-five percent (50–75%) of the stoichiometric ratio for the fuel employed. The fuel/air mixture is subsequently discharged into the combustion zone 12 of the chamber through the apertures 48. The serpentine geometry of the tubes imparts a circumferential swirl to the fuel/air mixture discharged therefrom. The swirling mixture is ignited in the combustion zone by the ignitor 34.

As the power level of the engine is increased, additional fuel is flowed via the supply means 38 to the secondary tube 20. The fuel in the secondary tube mixes with air flowing therethrough in a ratio which is less than approximately seventy-five percent (75%) of the stoichiometric ratio for the fuel employed. The fuel/air mixture is subsequently directed across the swirl vanes 42. The vanes impart a circumferential swirl to the mixture and in combination with the swirling fuel/air mixture from the primary tubes causes a strong centrifugal force field to develop within the combustion zone.

Igniting and burning the primary fuel/air mixture substantially reduces the density of the gases in the radially outward portion of the combustion zone. Accordingly, the fuel/air mixture from the secondary tubes is centrifuged outwardly into these hot, less dense gases. The hot gases raise the temperature of the secondary fuel/air mixture above the auto ignition point causing ignition of the secondary mixture. The forced mixing of the secondary fuel/air mixture into the combusting, primary, fuel/air mixture causes very rapid burning of the available fuel. Consequently, the time exposure of nitrogen and oxygen bearing gases to high combustion temperatures may be curtailed after short duration by the injection of temperature-modifying dilution air through the holes 32.

Figure 5:
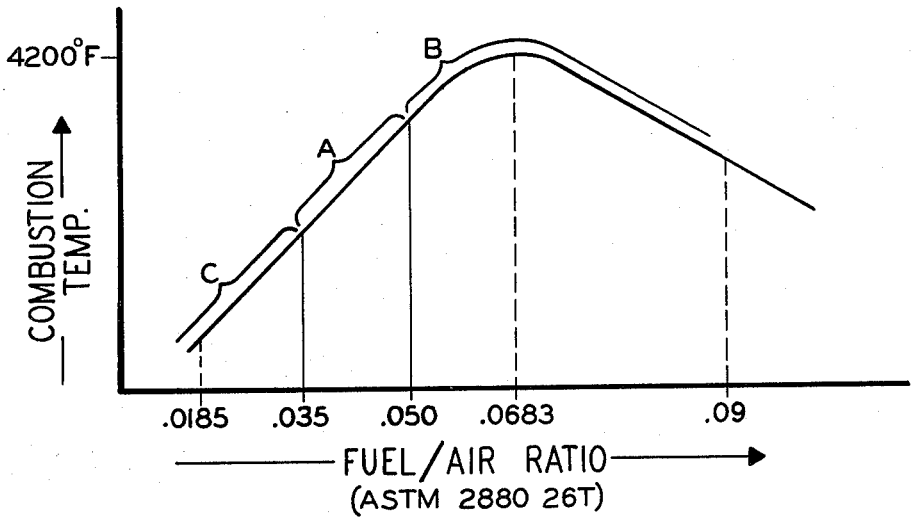
FIG. 5 is a graph illustrating the effect on combustor temperature of operation within the preferred fuel/air ratio disclosed.

The combustion technique described herein is more readily understandable by referring to the FIG. 5 graph of combustion temperature as a function of fuel/air ratio. It is the approach of the present invention that the combustor be operated at lean fuel/air ratios, that is in an oxygen rich environment in which the combustion temperature is substantially below the stoichiometric temperature. Fuel/air ratios not exceeding seventy-five percent (75%) of stoichiometric values adequately limit the production of nitrous oxide. Collaterally, excess oxygen assures complete combustion of the fuel and resultant low carbon monoxide emission.

To maintain low fuel/air ratios staged combustion is employed. Throughout the operating range of the engine, the fuel/air ratios in both the primary tubes and the secondary tubes is closely controlled.

Figure 6:
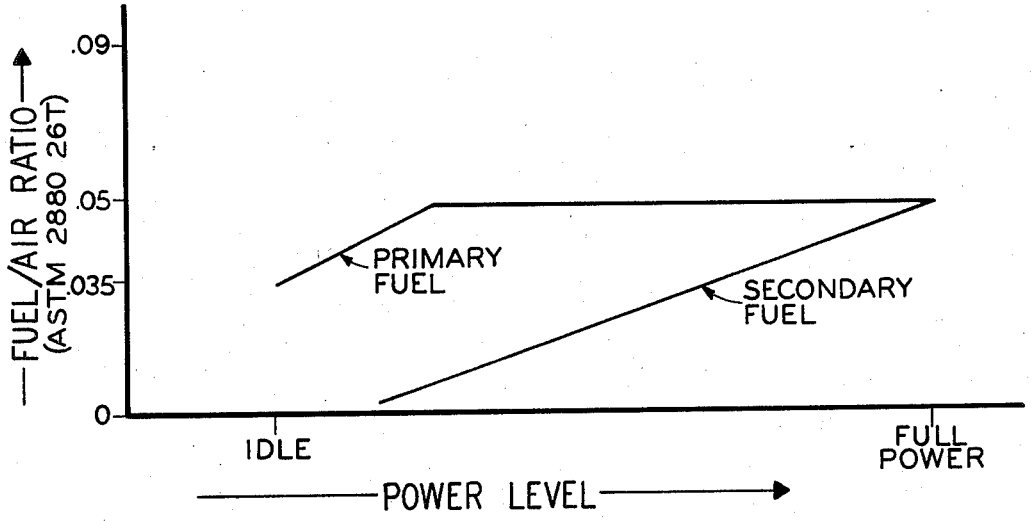
FIG. 6 is a graph illustrating a fuel staging technique employed in accordance with the concepts of the present invention.

The FIG. 6 graph illustrates the fuel staging technique and the corresponding fuel/air ratios for ASTM 2880 2GT, gas turbine No. 2 fuel oil. The fuel/air ratio in the primary tubes is maintained within the range of thirty-five thousandths to fifty thousandths (0.035 to 0.050). Within this range fuel is ignitable by the ignitor 34 and once ignited can maintain stable combustion. At some point above idle power, the secondary fuel begins to flow. It is noted from the FIG. 6 graph that the secondary fuel is flowable at initial ratios approaching zero. Although combustion could not be sustained at these low fuel/air ratios alone, in the present apparatus the secondary fuel/air mixture is centrifuged radially outward into the combusting primary fuel/air mixture. Within the combusting primary mixture the local temperatures of the mixing gases exceed the auto ignition point of the fuel and combustion of the secondary fuel is enabled. Combined primary and secondary fuel continue to flow as the engine approaches the full power. Note specifically at full power the fuel/air ratios of neither the primary nor the secondary mixing tubes exceed a value of fifty thousandths (0.050).

The full implications of this disclosed method of operation are understandable upon review of the FIG. 5 graph. The FIG. 5 graph illustrates the relationship between fuel/air ratio and combustion temperature.

The preferred fuel/air ratios for combustion within the burner is indicated by the range A. As long as the fuel/air ratio is maintained at values of fifty thousandths (0.050) or less, nitrous oxide emission as produced in the range B is avoided. Further insight can be derived from the FIG. 5 graph in relation to the lean flammability limit of fuel. The lean flammability limit may be defined as the minimum fuel/air ratio at which combustion can be sustained at a given temperature. For ASTM 2880 2GT, No. 2 gas turbine fuel oil, the lean flammability limit is approximately one hundred eighty-five ten thousandths (0.0185). Minimum fuel/air ratios of approximately thirty-five thousandths (0.035), however, are required to assure continuous stable combustion. The range C of the FIG. 5 graph defines an undesirably low range of fuel/air ratios.

In the apparatus described the lean flammability limit of the combined fuel/air mixture is the lean flammability limit of the primary fuel/air mixture. Combustion of the primary fuel/air mixture occurs throughout the operating range of the engine at fuel/air ratios between thirty-five thousandths and fifty thousandths (0.035–0.050). Fuel admitted through the secondary mixing tubes is centrifuged radially outward into the combusting primary fuel/air mixture. Once the secondary fuel becomes mixed with the combusting primary fuel/air mixture, the auto ignition point of the fuel is exceeded and the secondary fuel/air mixture is ignited. Highly stable combustion throughout the operating range of the engine results. Furthermore, lean burning and attendant low level of nitrous oxide production are assured.

The fuel/air ratios and temperatures described in this specification and illustrated in the drawing are those for ASTM 2880 2GT, a standard fuel burned in stationary gas turbine engines. The stoichiometric fuel/air ratio for this fuel is six hundred eighty-three ten thousandths (0.0683). Comparable fuel/air ratios and temperatures may be defined for other appropriate fuels and the concepts described and claimed herein are not restricted to the fuel specifically disclosed in this specification.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. A combustor structure having a combustion zone including a central portion and a radially outward portion encased by a cylindrical body, and having a fuel and air mixing zone upstream thereof which includes a main fuel and air mixing tube surrounded by a plurality of pilot fuel and air mixing tubes wherein said main tube includes means for circumferentially swirling effluent dischargeable therefrom into the central portion of the combustion zone and wherein said pilot tubes are so oriented as to cause effluent dischargeable therefrom to swirl circumferentially about the radially outward portion of the combustion zone.

2. The invention according to claim 1 wherein said main fuel and air mixing tube has a swirler at the downstream end thereof.

3. The invention according to claim 2 wherein said pilot tubes have a serpentine geometry.

4. The invention according to claim 3 which further includes means for flowing fuel to said pilot tubes and means, independent of said pilot fuel means, for flowing fuel to said main tube.

5. A combustor having a combustion zone including a central portion and a radially outward portion, and having a fuel/air mixing zone upstream of the combustion zone, wherein the improvement comprises:

a plurality of primary, fuel/air mixing tubes oriented to discharge a mixture of fuel and air circumferentially into said radially outward portion of the combustor, a secondary, fuel/air mixing tube having means for swirling a fuel/air mixture circumferentially into said central portion of the combustor, and means for igniting the primary fuel/air mixture so as to cause the swirling, secondary fuel/air mixture to be centrifuged outwardly into the burning primary fuel/air mixture.

6. A method for operating a combustor of the type having a secondary fuel/air mixing tube and a plurality of primary fuel/air mixing tubes spaced radially outward therefrom, wherein the improvement comprises:

flowing fuel and air into said primary mixing tubes at a ratio between approximately fifty to seventy-five percent (50–75%) of the stoichiometric ratio for the fuel employed;

mixing said fuel and air in the primary mixing tubes;

discharging said mixture from the primary mixing tubes circumferentially into the outer portion of the combustor;

igniting said mixture from the primary mixing tubes;

flowing fuel and air into said secondary mixing tube at a ratio not exceeding approximately seventy-five percent (75%) of the stoichiometric ratio for the fuel employed;

mixing said fuel and air in the secondary mixing tube;

imparting a circumferential swirl to the fuel and air mixture;

discharging the swirling fuel and air mixture from the secondary tube to the central portion of the combustor, whereby the secondary fuel and air mixture is centrifuged radially outward into the ignited primary mixture.

* * * * *